United States Patent [19]

Fedders

[11] Patent Number: 4,526,163

[45] Date of Patent: Jul. 2, 1985

[54] MASSAGER

[76] Inventor: Merle Fedders, 371 North St., Meadville, Pa. 16335

[21] Appl. No.: 431,032

[22] Filed: Sep. 30, 1982

[51] Int. Cl.[3] ..... A61H 7/00

[52] U.S. Cl. ..... 128/56; 128/59

[58] Field of Search ..... 128/46, 56, 59, 60; 74/48, 66, 56 A, 98

[56] References Cited

U.S. PATENT DOCUMENTS

| | | | |
|---|---|---|---|
| 1,635,497 | 7/1927 | Rüttger-Pelli | 128/56 |
| 1,777,151 | 9/1930 | Rüttger-Pelli | 128/59 X |
| 2,043,114 | 6/1936 | Rüttger-Pelli | 128/56 |

FOREIGN PATENT DOCUMENTS

| | | | |
|---|---|---|---|
| 1125994 | 11/1956 | France | 128/56 |

*Primary Examiner*—Richard J. Apley
*Assistant Examiner*—David J. Brown
*Attorney, Agent, or Firm*—Charles L. Lovercheck; Wayne L. Lovercheck; Dale R. Lovercheck

[57] ABSTRACT

A massager for massaging the body is disclosed having a disk with a plurality of shafts around a central central shaft. Each of the shafts have a resilient member on it for engaging the body of a person. These shafts are driven so that the outside shafts all rotate in a first direction and the center shaft rotates in the opposite direction. They are driven so that they rotate first in one direction a part of a turn and then they rotate in the other direction a part of a turn. The drive may be a central gear fixed to the center shaft and a small gear fixed to each of the small shafts and making meshing engagement with the large gear so that when the large shaft is rotated in one direction the central member rotates with it and the other members all rotate in the opposite direction. The drive shown is a disk supported on the shaft with a radial slot and the radial slot is engaged by the crank of a motor so that when the motor rotates the shaft having the center member on it oscillates first in one direction and then in the other.

4 Claims, 2 Drawing Figures

MASSAGER

GENERAL DESCRIPTION OF THE INVENTION

The invention disclosed herein is a massager which may be held in contact with the skin and the center member rotating in a different direction than those around it which give the skin a particular massaging action that is unique and beneficial to the skin.

REFERENCE TO PRIOR ART

Applicant is aware of the following U.S. patents but none of them disclose a massaging device that has the particular action of Applicant's. U.S. Pat. Nos. 1,635,497, 2,285,105, and 2,500,578.

OBJECTS OF THE INVENTION

It is an object of the invention to provide an improved massager.

Another object is to provide a massager that has several skin engaging members that rotate in opposite directions.

Another object of the invention is to provide a massager that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
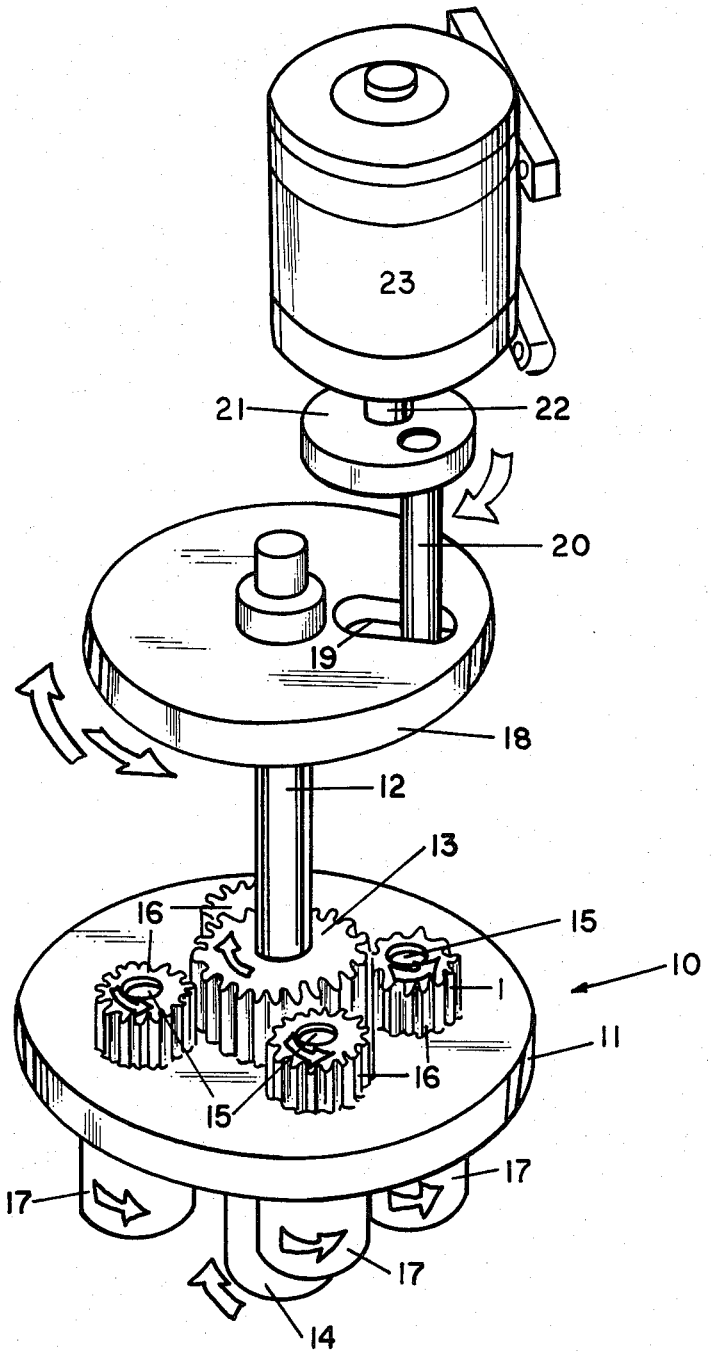
FIG. 1 shows a view of the working parts of the massager according to the invention.
Figure 2:
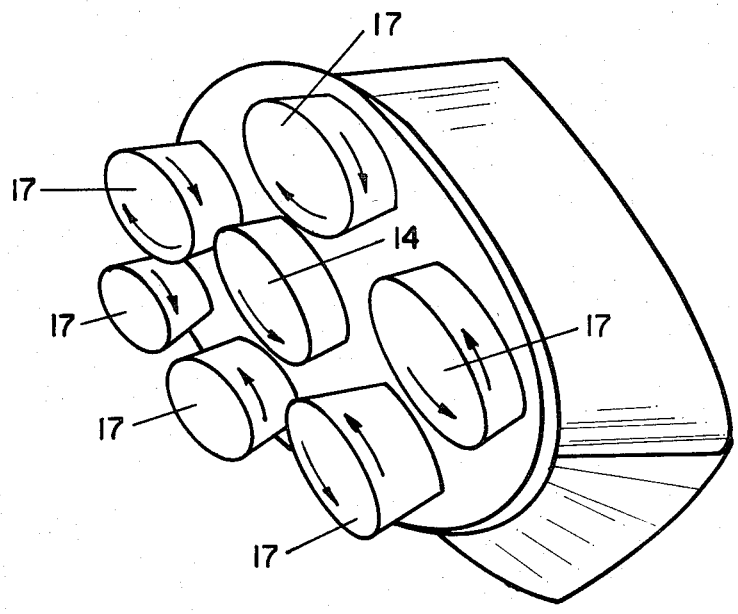
FIG. 2 shows an isometric view of the underside of the massager shown in FIG. 1 with a cover in place.

Now, with more particular reference to the drawing, I show a massager 10 which is made up of a first disk 11 which has a first central shaft 12 that extends through the disk to the opposite side and has a central member first body engaging means 14 fixed to it. Large gear 13 is approximately twice the diameter of small gears 16 as shown, which results in the small gears rotating at approximately twice the speed of the gear 13. It will be seen that the position of the motor 23 is such that its central shaft 22 is transversely spaced relative to the axis of the first shaft 12. A plurality of second shafts 15 extend through the disk 11 and each of the second shafts 15 have a small gear or second driving means 16 fixed to its upper end and a second body engaging means 17 fixed to its lower end at second shaft 15 at the side of the disk remote from the gears or first and second driving means 13 and 16 respectively. The large gear 13 has teeth which engage teeth on small gear 16 in a conventional manner. The crank pin 20 is excentrically mounted on third disk 21. The slot 19 is so positioned that as disk 21 is rotated by motor 23, shaft 20 will move from one end of slot 19 to the other and thereby rotate second disk 18 first in one direction then in the other. This form of device is familiar to those skilled in the art. Thus when the first central shaft 12 is rotated in a first direction the small gears or second driving means 16 will rotate in the opposite direction giving the two body engaging means 14 and 17 a unique oscillating motion. The tips of the skin engaging means are convex and frictionally engage the skin.

The first central shaft 12 is driven in first a clockwise and then a counterclockwise direction as indicated by the arrows. The second disk 18 is fixed to the first central shaft 12 and has a radially extending slot 19 which receives the crank pin 20 on the crank third disk 21 which is fixed to the shaft 22 of motor 23. Therefore, when the motor rotates in a first direction the crank pin 20 pushes second disk 18 around in a counterclockwise direction during the first part of its stroke and then oscillates it back as the crank pin 20 comes around. This is a conventional type of drive which is found on old fashioned domestic clothes washing machines.

The massager will have a suitable case supported around it and may have a suitable handle for conventionally holding it. The massager is operated by means of a conventional source of electricity connected to the motor 23 which will cause it to oscillate the members and when the members 14 and 17 are held in firm contact with the skin of a person they give it a refreshing oscillating motion.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A massage device comprising, a first disk, a first central shaft having a first and second end, said first central shaft extending through said first disk and rotatably supported thereon, a first body engaging means, said first body engaging means being supported on said second end of said first central shaft, a first driving means, said first driving means being supported on said second shaft on the side of the first disk remote from said first body engaging means, a second shaft having first and second ends, said second shaft extending through and rotatably supported on said first disk and being transversely spaced from the longitudinal axis of said first central shaft, a second body engaging means on said second end of said second shaft, a second driving means located on said first end of said second shaft and said second driving means engaging said first driving means, a second disk, said second disk being connected to said first end of said first shaft, said second disk having a radially extending slot therein, a motor means having an eccentric crank pin thereon, said eccentric pin being received in said radially extending slot whereby rotation of said crank pin oscillates said first central shaft in a first direction and then in a second direction whereby said first body engaging means is rotated in a first direction and then in a second direction, said second body engaging means is rotated in a second direction and then a first direction respectively, whereby the body of a person engaged by said first body engaging means and said second body engaging means is given an invigorating massage when said motor means oscillates said first central shaft.

2. The massager recited in claim 1 wherein said motor means drives said first central shaft a part of a turn in a first direction and then drives said first central shaft a part of a turn in a second direction.

3. The massager recited in claim 2 wherein a plurality of said second body engaging means are supported on said first disk, said second driving means drives said all of said plurality of said second body engaging means in the same direction.

4. The massager recited in claim 2 wherein said first drive means on said first shaft is larger than said second drive means on said second shaft whereby said drive means on said second shaft rotate at a higher speed than the drive means on said first shaft.

* * * * *